United States Patent [19]

Worcester et al.

[11] Patent Number: 4,808,376

[45] Date of Patent: Feb. 28, 1989

[54] METHOD OF ALLOYING ALUMINUM AND CALCIUM INTO LEAD

[75] Inventors: Anthony W. Worcester, Oakville; Kai Ravnborg, Herculaneum, both of Mo.; Carlos E. Aguirre, Downingtown, Pa.

[73] Assignee: The Doe Run Company, Herculaneum, Mo.

[21] Appl. No.: 83,822

[22] Filed: Aug. 10, 1987

[51] Int. Cl.[4] ..... C22C 11/02; C22C 1/00

[52] U.S. Cl. ..... 420/564; 420/590

[58] Field of Search ..... 420/564, 590

[56] References Cited

U.S. PATENT DOCUMENTS

| | | | |
|---|---|---|---|
| 3,741,754 | 6/1973 | Mainland | 420/564 |
| 4,439,398 | 3/1984 | Prengaman | 420/564 |
| 4,627,961 | 12/1986 | Dudek | 420/564 |
| 4,652,299 | 3/1987 | Bienvenu et al. | 75/58 |

FOREIGN PATENT DOCUMENTS

| | | | |
|---|---|---|---|
| 0975180 | 9/1975 | Canada | 420/564 |
| 2427300 | 1/1975 | Fed. Rep. of Germany | 420/564 |

*Primary Examiner*—L. Dewayne Rutledge
*Assistant Examiner*—David Schumaker
*Attorney, Agent, or Firm*—Senniger, Powers, Leavitt and Roedel

[57] ABSTRACT

A method of alloying powdered aluminum into lead to form lead-calcium-aluminum alloys with relatively high recoveries and low standard deviations of recoveries. The method comprises melting lead, heating the lead, injecting simultaneously calcium-containing granules and aluminum powder into the lead under the surface. The alloying material preferably has a total calcium content of between about 65% and 80% by weight and a total aluminum content of between about 35% and 20%. The material is preferably injected into an injection bell to hold the alloying material under the surface of the lead.

18 Claims, 2 Drawing Sheets

METHOD OF ALLOYING ALUMINUM AND CALCIUM INTO LEAD

BACKGROUND OF THE INVENTION

This invention relates to a method of alloying aluminum into lead, and in particular to a method of alloying aluminum powder into lead to form lead-calcium-aluminum alloys.

Lead-calcium-aluminum alloys are used to make battery grids. The presence of aluminum in the alloy helps to protect the calcium content of the alloy during formation of the grids. However, alloying aluminum into lead has long been a problem. In most alloying operations at least some of the alloying material is lost to the formation of slag or otherwise. The difficulty of, and low recoveries from, the direct alloying of aluminum powder or molten aluminum into lead is well known. "Recovery" as used herein refers to the percent of the alloying material that is successfully alloyed. Furthermore, the alloying of aluminum into lead had previously resulted in unpredictable recoveries. That is the standard deviation for the aluminum recoveries in present alloying techniques is quite high, and thus it has been difficult to achieve a preselected aluminum content in one alloying step with any certainty. One or more supplemental alloying steps were often required to bring the aluminum content within the preselected range. These supplemental alloying steps greatly increase the cost of making such alloys because they tie up the refining equipment and personnel, and disrupt scheduling in the plant.

Presently, most lead-calcium-aluminum alloys are made by one of two methods: (1) dropping brickettes of a calcium aluminum mixture into the molten lead and stirring, (2) dropping chunks of calcium and pouring molten aluminum into molten lead and stirring. These alloying reactions are strongly exothermic, and generate so much heat that the lead actually burns, forming lead oxide fumes, which can be a health hazard. Moreover, the calcium may also fume, forming caustic fumes which can be an eye and skin irritant. For these reasons alloying is sometimes conducted under a ventilated cover, but this is cumbersome.

Furthermore, the recoveries of calcium and aluminum with these methods of alloying are relatively low and unpredictable. For example, the inventors have found that use of calcium aluminum brickettes on a commercial scale typically results in recoveries of calcium of 89%±5.27% and recoveries of aluminum of 71.7%±17.66%. Thus within the first standard deviation the actual calcium content for any given alloy made by this method can vay by over 10% and the actual aluminum content for suqh an alloy can vary by over 34%. With such large variations it is difficult to reach a preselected content in just one alloying step without the need for adjustment. Similarly, the inventors have found that use of lump calcium and molten aluminum on a commercial scale typically results in recoveries of calcium of 84.7%±7.36% and recoveries of aluminum of 55.26%±10.69%. Thus within the first standard deviation the actual calcium content for any given alloy made by this process can vary by over 14% and the actual aluminum content of such an alloy can vary by over 21%. Again, with such large variations it is difficult to reach a preselected content in just one alloying step without the need for adjustment.

Because of the relatively high alloying losses, and the unpredictability of the alloying reactions evidenced by the relatively high standard deviations associated with the recoveries (particularly aluminum) the cost of obtaining a given alloy composition has been quite high. After a first attempt at reaching a specified alloy composition, a sample must be drawn and analyzed. If the content is not within the specifications one or more supplemental alloying operations are required to bring the content within specification. The inventors have found that supplemental alloying steps are needed more than 50% of the time. This is costly not just in terms of the additional alloying material needed, but these supplemental alloying operations tie up refinery equipment and personnel, and interfere with scheduling.

There have been suggestions in the art to add calcium to molten metals, such as to steels for purification, by injecting specially made calcium granules into the molten metal under the surface. It has even been suggested, but to the inventors' knowledge never previously proven, that calcium could be alloyed into lead by such a method. However, such a method of alloying calcium into lead makes no provision for the addition of aluminum to protect the calcium content of the alloy, and thus was of little or no use. Furthermore, there was no indication whether the uncertainties of the recoveries would be in any way improved. Calcium granules containing alloyed aluminum became available, but the maximum aluminum content of such granules was very low, about 12%. Thus, obtaining a sufficient aluminum content to protect the calcium would have required a large amount of such granules, would have wasted a great deal of calcium, and would have been prohibitively expensive. Given the well-known problems of adding aluminum, even molten aluminum, to lead, there appeared to be no satisfactory way of adding aluminum to lead with this method.

SUMMARY OF THE INVENTION

It is among the objects of the present invention to provide a method of alloying aluminum into lead to form lead-calcium-aluminu alloys; it is an object of this invention to provide such a method that achieves relatively high and certain recoveries of the aluminum, thereby reducing the cost of making an alloy of a given composition. It is also among the objects of the present invention to provide such a method that allows the direct alloying of aluminum powder into lead. Finally it is among the objects of the present invention to provide such a method that reduces the generation of hazardous fumes, and thus the need for a ventilated cover during alloying.

Generally the method of alloying aluminum into lead according to the present invention comprises the simultaneous introduction of calcium granules, calcium aluminum alloy granules, or a combination of both together with powdered aluminum at a point under the surface of molten lead. This alloying material is preferably carried by a relatively inert gas through a lance into a reaction bell immersed in the the molten lead to hold the alloying material under the surface of the lead while the alloying reaction occurs. Contrary to the teachings of the art that aluminum is difficult to alloy directly into lead, recoveries from this method of direct addition of aluminum have been relatively high, and the certainty of the recoveries of both calcium and aluminum are significantly improved over the prior art. The alloying material preferably has a combined calcium content of about 75% and a combined aluminum content of about 25%, although this can be varied.

The preferred temperature range for alloying is generally between about 1020° F. and about 1080° F., and for particular conditions the optimum temperature can be determined by routine experiment. The optimum flow rate of alloying material in a commercial scale process is between about 12 and 21 pounds of alloying material material per minute, and for particular conditions the optimum flow rate can also be determined by routine experiment.

With this method, the generation of lead oxide fumes and other fumes from the alloying elements is greatly reduced. Thus the method reduces the environmental hazard and eliminates the need for ventilated covers. Furthermore, the recoveries of calcium and aluminum are improved, and the certainty of the recoveries are significantly improved. The inventors have found that calcium recoveries with the present method have been 90.8%±2.9% and aluminum recoveries of 55%±5.0%. The recoveries compare favorably with the prior art brickette method which resulted in recoveries of 89%±5.27% for calcium and 71.7%±17.66%, and the prior art chunk calcium/molten aluminum method which resulted in recoveries of 84.7%±7.36% for calcium and 55.26%±10.69% for aluminum. Most important, however, is the repeatability of the method as evidenced by the very low standard deviations for the recoveries. In contrast with the inventors' experience with prior methods of making lead-calcium-aluminum alloys, within the first standard deviation the calcium content of a given alloy made according to the present method varies by only about 6%, as compared with over 10% with the brickette method and over 14% with the chunk calcium/molten aluminum method, and the aluminum content of a given alloy made according to the present method varies by only 10% as compared with over 34% with the brickette method and over 21% with the chunk calcium/molten aluminum method. With the present method the recoveries are much more certain, and thus it is possible to reliably reach the target content in the first alloying step, and greatly reduce the need for supplemental alloying steps. With the present method the alloyer knows that within one standard deviation, the resulting alloy will be within a narrow range of the target content. This greatly reduces the cost of making lead-calcium-aluminum alloys.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
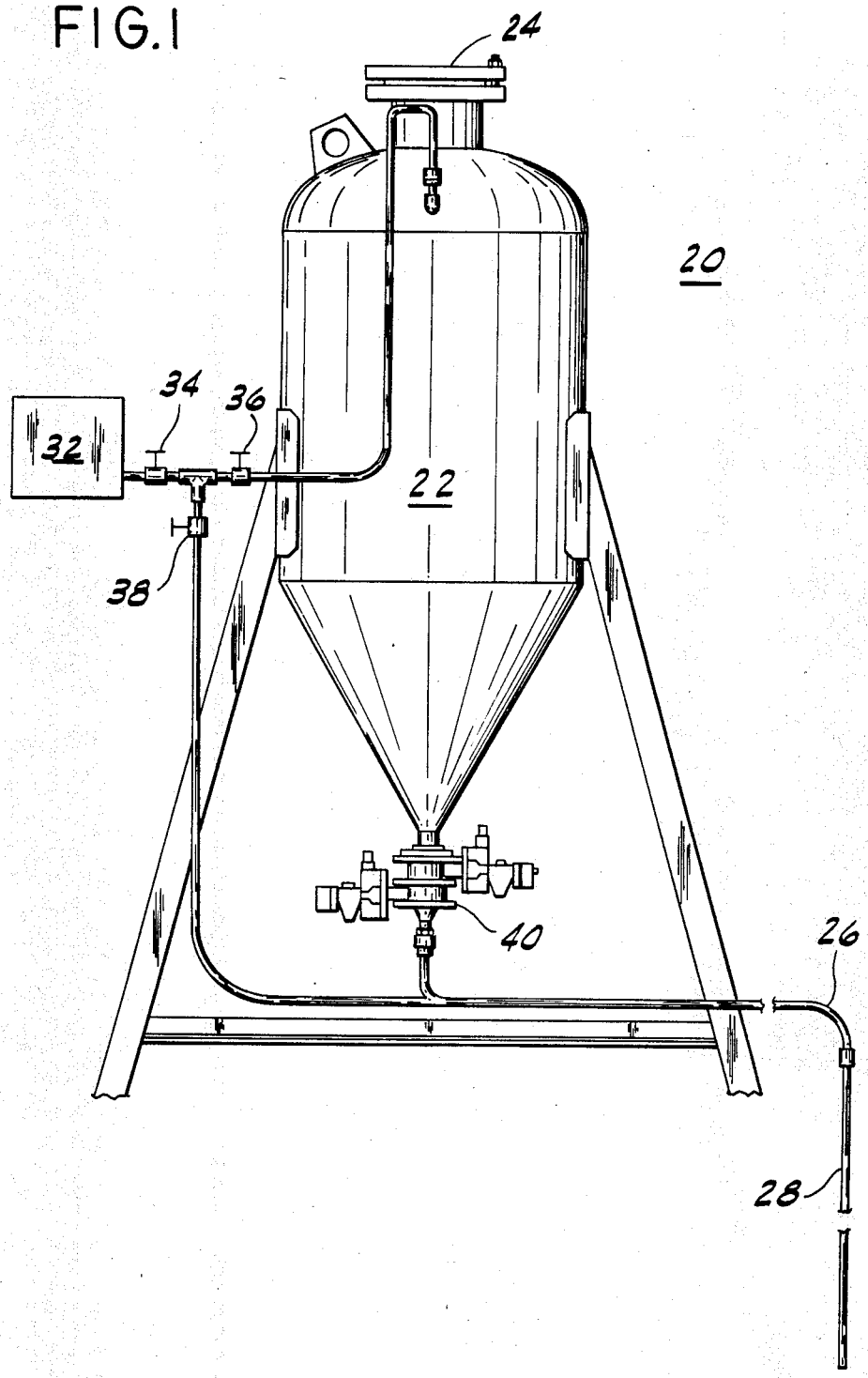
FIG. 1 is a schematic view of an injector unit for use with the present invention.
Figure 2:
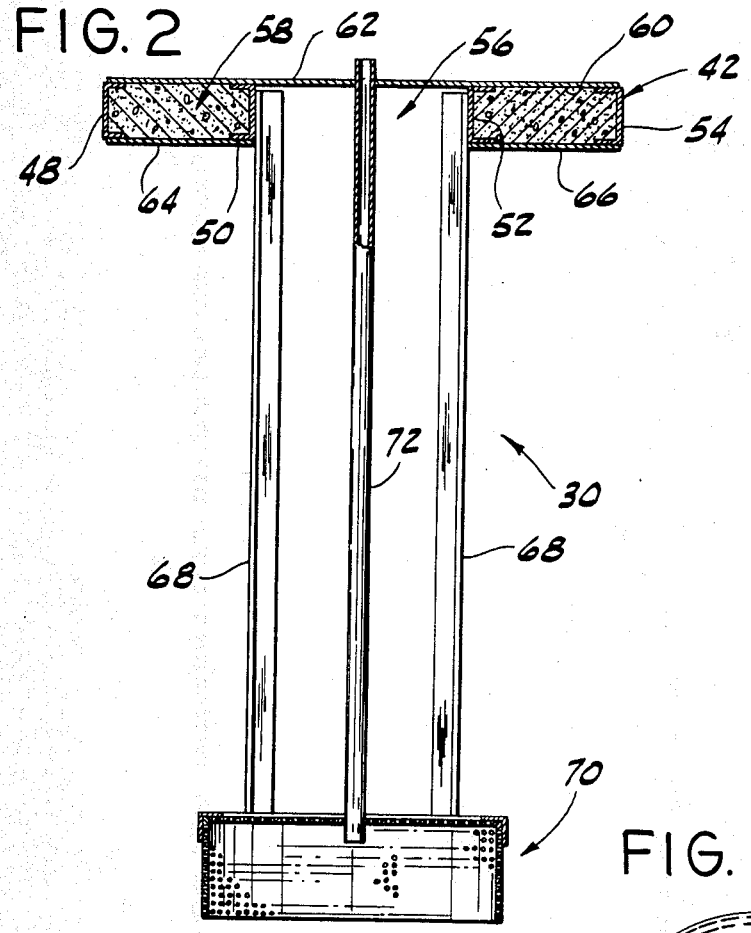
FIG. 2 is a side elevation view of a reaction bell adapted for use in the method of the present invention.
Figure 4:
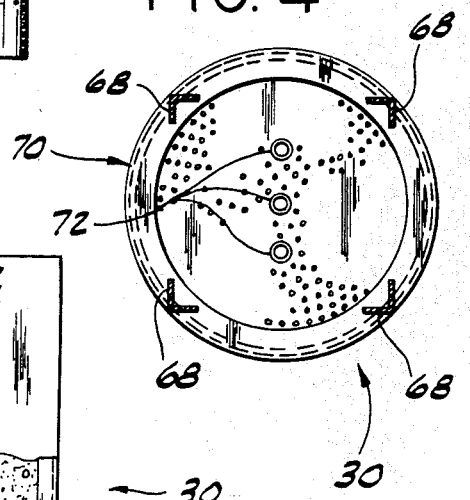
FIG. 4 is a bottom plan view of the reaction bell.
Figure 3:
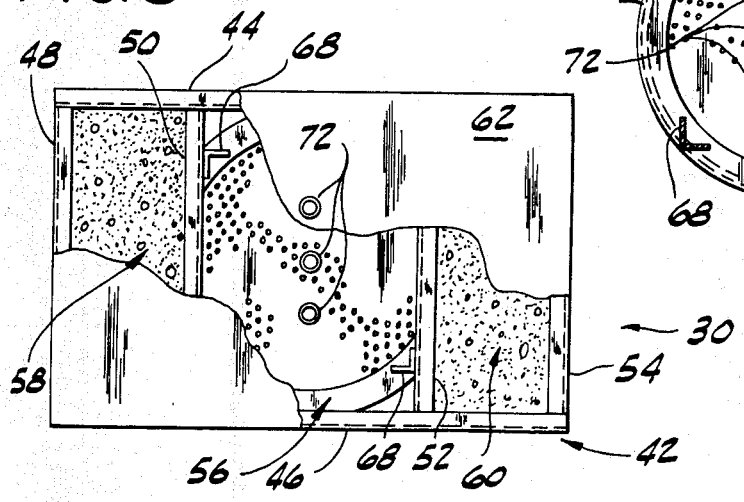
FIG. 3 is a top plan view of the reaction bell.

According to the method of alloying aluminum into lead of the present invention, the alloying material, calcium granules, calcium/aluminum granules, or both, together with aluminum powder, is simultaneously introduced into molten lead at a point beneath the surface of the lead. Suitable granules for this process are AJEXCal-HP pure calcium granules, and AJEXCal A12 calcium granules with 12% alloyed aluminum, these latter granules are available in premixed with aluminum powder as AJEXCal-75/25 and AJEXCal-80/20. The granules range between about 0.2 mm and about 2 mm in size. The production of the granules is patented under European Pat. No. 0048713 and U.S. Pat. No. 4,428,894. The granules are distributed by A. Johnson Metals Corp., Lionville-Exton, Pa. The introduction may be accomplished by injecting the alloying material with a relatively inert gas carrier through an injector unit. The injector unit preferably outputs through a lance immersed in the molten lead. The lance preferably outputs into a reaction bell which temporarily contains the alloying material, holding it under the surface and delaying its diffusion throughout the molten lead, and thereby increasing the time for the alloying reaction to occur.

The inventors have empirically determined that the content of the alloying material is preferably about 75% by weight calcium and about 25% aluminum. The preferred range of the content of the alloying material is between about 65% and about 80% calcium, and between about 35% and 20% aluminum. For a particular application, other contents may be appropriate. The total aluminum content of the charge of the alloying material appears to be more important than what fraction of the aluminum is in the granules and what fraction of the aluminum is powder.

The flow rate of alloying material depends upon the amount of lead being alloyed, but for most commercial scale (i.e. about 250 tons) operations with one point of injection the inventors have empirically determined that the preferred injection rate for the alloying material is about 18 pounds per minute under most conditions. The preferred range is between about 12 pounds per minute and about 21 pounds per minute. While rates slower than 12 pounds per minute result in high recoveries, the injection time required in a commercial operation generally makes the process uneconomical. Furthermore, such low rates of injection increase the chances that the injection lance will plug. With rates above 21 pounds per minute recoveries are reduced. The actual alloying time depends upon the amount of lead being alloyed and the desired final composition. The flow rate is maintained until sufficient alloying material has been added to achieve the desired final content.

The inventors have empirically determined that the preferred temperature for the process is about 1050° F. The preferred temperature range is between about 1020° F. and about 1080° F. At temperatures below 1020° F. the solubility of aluminum in lead is low, so it is generally desirable to keep the temperature above this level. It is likewise desirable to keep the temperature below 1080° F. to keep the calcium alloying reaction in check.

An example of a suitable injector is shown schematically as 20 in FIG. 1. This is a standard injector of the type known in the art for injection of, for example calcium for purification of steels. A suitable injector is available, for example, from Extramet Industrie, Annemasse, France. This injector includes a 500 liter stainless steel pressure vessel 22 with a conical bottom, and a recloseable lid 24. A steel wire braided high-pressure rubber carrier hose 26 is connected to the outlet of vessel 22. A lance 28 is connected to the remote end of hose 26. This lance is preferably a 0.5 inch i.d. eight foot length of black iron pipe. Lance 28 is adapted to fit into a specially designed reaction bell 30, described below.

A charge of alloying material is placed in the vessel 22 and the lid 24 is secured. The charge of alloying material is preferably a mixture of calcium/aluminum granules and aluminum. Calcium/aluminum alloy granules have a lower melting point than pure calcium granules, which allows for easier dissolution. The presence of aluminum in the granules is also believed to reduce the vapor pressure of the calcium, retarding vapor loss. The injector 20 is then pressurized by connecting it to a source 32 of a relatively inert gas. This may be accomplished by opening valves 34 and 36 between gas source 32 and vessel 22. The "relatively inert" gas can be an inert gas, for example argon, or some other gas substantially non-reactive with the calcium, aluminum, lead system, for example carbon dioxide. Carbon dioxide is desirable because it is inexpensive. Another possible gas is natural gas or methane, which is also relatively inexpensive.

A flow of relatively inert gas is established through the carrier hose 26 by opening valve 38 between source 32 and hose 26. Valve 40 at the bottom of the pressure vessel 22 is then opened, and the alloying material, because of gravity and the venturi established by the gas flowing through the carrier hose 26, is drawn into the carrier hose 26. The alloying material is carried through the hose 26 to lance 28 which is received in reaction bell 30.

Reaction bell 30, comprises a top frame 42 having two side members 44 and 46, and four cross members 48, 50, 52 and 54. The cross members divide the frame into a center section 56 and two side sections 58 and 60. A metal plate 62 covers the top frame 42. Metal panels 64 and 66 close the bottoms of side sections 58 ahd 60, respectively. These side sections form pockets which are filled with concrete to ballast the reaction bell.

Four standards 68, made of angle iron, depend from frame 42. An open-bottomed, cylindrical reaction chamber 70 is attached to the lower ends of the standards. At least one, and preferably three tubes 72 extend between the frame 32 and the reaction chamber 70. These tubes are adapted to receive the lance 28, and more than one is provided in case a lance becomes plugged.

The lance 28 injects the alloying material into the molten lead. Because of the density of the lead, the calcium and aluminum alloying material floats upwardly. The reaction chamber 70 is preferably sized to trap the alloying material and hold it under the surface of the molten lead for sufficient time for the alloying reaction to occur. The top and sides of the reaction chamber are preferably perforated to allow flow through the chamber. The perforations are sized to trap granules and most of the aluminum power but allow the carrier gas to escape. The perforations also permit partially dissolved alloying material to escape after it is sufficiently small that it will dissolve before it can reach to the surface. These perforations may be 0.094 inch diameter holes spaced to make the chamber about 50% open.

OPERATION

In the preferred embodiment lead is melted in a kettle, and brought to a temperature of between about 1020° F. and about 1080° F., and preferably about 1050° F. The reaction bell 30 is inserted into the kettle, with the reaction chamber 70 immersed well below the surface of the lead. In a 250 ton commercial-scale kettle, the reaction chamber is as much as five or six feet below the surface. The vessel 22 is filled with the alloying material, (preferably a combination of calcium granules, calcium aluminum granules, or both, together with aluminum powder) having a total composition of between 65% and 80% calcium and 35% and 20% aluminum, depending upon the desired alloy. The amount of alloying material depends upon the amount of lead in the kettle and the desired composition of the end product. The amount of alloying material is easily calculated from the previously experienced recoveries under the same conditions. Because of the low standard deviation in the recoveries obtained with this process, the amount of alloying material can be accurately determined in advance, and supplemental alloying steps generally will not be needed.

The lance 28 is inserted into one of the tubes 72 in the reaction bell 30. Gas flow is initiated through tube 26 and out lance 28 in bell 30. Once a stable flow is established, valve 40 on the vessel 22 is operated to allow the alloying material to be drawn through tube 26 and out lance 28 into the molten lead. A flow rate of between about 12 and about 21 pounds per minute is established, and preferably about 18 pounds per minute. Once injected into the molten lead, the carrier gas and the alloying material float upwardly. The reaction chamber 70 traps most of the alloying material, but allows the carrier gas to pass upwardly to the surface. The reaction chamber 70 holds the alloying material under the surface of the lead for a sufficient time for alloying to take place. The inventors estimate that the residence time of the alloying material in the reaction chamber is approximately one minute. It is believed that the strongly exothermic reaction of the calcium-lead alloying reaction in the chamber 70 facilitates the alloying of the powdered aluminum with the lead. The perforations in the reaction chamber 70 allow lead to flow through the chamber and allow small particles of the alloying materials to escape. The particles that can escape are generally so small that they will completely dissolve before they reach the surface.

Once the alloying is complete the lead-calcium-aluminum alloy is tested and if the content is not within specification it can be adjusted by the addition of additional alloying material. However, because of the relatively low standard deviation for recoveries with the present method, such supplemental alloying (which was needed over 50% of the time in the inventors' experience with prior art alloying methods), is generally not needed.

The following examples illustrate the method of this invention:

EXAMPLE #1

250 tons of lead were melted in a kettle, and heated to a temperature of about 850° F. The amount of alloying material necessary to reach the desired final content of 0.091% calcium, 0.02% aluminum, balance lead, was calculated taking into account the standard recoveries from the method of 90.8%±2.9% for calcium and 55%±5.0% for aluminum, and determined to be 527 pounds of calcium and 167 pounds of aluminum. These amounts of calcium and aluminum were injecting into the molten lead by injecting 586.25 pounds of calcium aluminum granules, 25 pounds of calcium granules, and 83.75 pounds of aluminum powder. The material was injected with $CO_2$ gas at a rate of about 17 pounds per minute. When the injection was complete an assay was made and the final composition was determined as: 0.098% calcium, and 0.019% aluminum, balance lead. The recoveries were thus 93.9% of the calcium and 44.6% of the aluminum. The recovery of the aluminum was depressed because of the low temperature of the alloying operation.

EXAMPLE #2

250 tons of lead were melted in a kettle, and heated to a temperature of about 1027° F. The amount of alloying material necessary to reach the desired final content of 0.13% calcium, 0.025% aluminum, balance lead, was calculated taking into account the standard recoveries from the method of 90.8%±2.9% for calcium and 55%±5.0% for aluminum, and determined to be 684 pounds of calcium and 228 pounds of aluminum. These amounts of calcium and aluminum were injecting into the molten lead by injecting 798 pounds of calcium aluminum granules and 114 pounds of aluminum powder. The material was injected with $CO_2$ gas at a rate of about 14.7 pounds per minute. When the injection was complete an assay was made and the final composition was determined as: 0.129% calcium, and 0.026% aluminum, balance lead. The recoveries were thus 95.0% of the calcium and 59.2% of the aluminum.

EXAMPLE #3

250 tons of lead were melted in a kettle, and heated to a temperature of about 1045° F. The amount of alloying material necessary to reach the desired final content of 0.11% calcium, 0.025% aluminum, balance lead, was calculated taking into account the standard recoveries from the method of 90.8%±2.9% for calcium and 55%±5.0% for aluminum, and determined to be 600 pounds of calcium and 200 pounds of aluminum. These amounts of calcium and aluminum were injecting into the molten lead by injecting 500 pounds of calcium aluminum granules and 100 pounds of aluminum powder. The material was injected with $CO_2$ gas at a rate of about 14.5 pounds per minute. When the injection was complete an assay was made and the final composition was determined as: 0.102% calcium, and 0.024% aluminum, balance lead. The recoveries were thus 88.3% of the calcium and 62.5% of the aluminum.

There are various changes and modifications which may be made to the invention as would be apparent to those skilled in the art. However, any of these changes or modifications are included in the teachings of the inventors' disclosure and they intend that their invention be limited only by the scope of the claims appended hereto.

What is claimed is:

1. A method of alloying calcium and aluminum into lead comprising the step of:

melting lead in a vessel;

introducing simultaneously a mixture of calcium-containing granules and powdered aluminum into the lead at a point under the surface of the molten lead;

holding the calcium-containing granules and powdered aluminum under the surface of the molten lead for sufficient time for alloying to occur.

2. The method according to claim 1 further comprising the step of heating the lead to a temperature of between about 1020° F. and 1080° F. before the introduction of the calcium-containing granules and powdered aluminum.

3. The method according to claim 2 wherein the lead is heated to a temperature of about 1050° F.

4. The method according to claim 1 wherein the calcium-containing granules and aluminum powder have a combined total composition of between about 65% and about 80% by weight calcium and between about 35% and about 20% aluminum.

5. The method according to claim 4 wherein the calcium containing granules and aluminum powder have a combined total composition of about 75% by weight calcium and about 25% aluminum.

6. The method according to claim 1 wherein the calcium granules and aluminum powder are introduced at a total rate of between about 12 pounds per minute and about 21 pounds per minute.

7. The method according to claim 6 wherein the calcium granules and aluminum powder are introduced at total rate of about 18 pounds per minute.

8. The method according to claim 1 wherein the calcium-containing granules and aluminum are injected into the lead with an inert gas carrier.

9. The method according to claim 8 wherein the calcium-containing granules and aluminum are injected into a reaction bell below the surface of the lead.

10. The method according to claim 9 wherein the reaction bell includes an open-bottomed, perforated reaction chamber for holding the alloying material injected into the molten lead under the surface.

11. A method of alloying calcium and aluminum into lead comprising the step of:

melting lead in a vessel;

heating the lead to a temperature of between about 1020° F. and 1080° F.

introducing simultaneously a mixture of calcium-containing granules and powdered aluminum into the lead under the surface of the molten lead;

holding the calcium-containing granules and powdered aluminum under the surface of the molten lead for sufficient time for alloying to occur.

12. The method according to claim 11 wherein the calcium-containing granules and aluminum are injected into a reaction bell below the surface of the lead.

13. The method according to claim 9 wherein the reaction bell includes an open-bottomed, perforated reaction chamber for holding the alloying material injected into the molten lead under the surface.

14. The method according to claim 11 wherein the calcium-containing granules and aluminum powder have a combined total cmoposition of between about 65% and about 80% by weight calcium and between about 35% and about 20% aluminum.

15. The method according to claim 14 wherein the calcium containing granules and aluminum powder have a combined total composition of about 75% by weight calcium and about 25% aluminum.

16. The method according to claim 11 wherein the calcium granules and aluminum powder are introduced at a total rate of between about 12 pounds per minute and about 21 pounds per minute.

17. A method of alloying calcium and aluminum into lead comprising the step of:

melting lead in a vessel;

heating the lead to a temperature of between about 1020° F. and 1080° F.;

injecting simultaneously a mixture of calcium-containing granules and powdered aluminum, having a combined total calcium content of between about 65% and 80% by weight and a combined total aluminum content of between about 35% and 20%, into the lead under the surface of the molten lead.

18. The method according to claim 17 wherein the calcium-containing granules and aluminum are injected into the lead with an inert gas carrier.

* * * * *